US007300491B2

(12) United States Patent
Hirata et al.

(10) Patent No.: US 7,300,491 B2
(45) **Date of Patent: *Nov. 27, 2007**

(54) METHOD AND APPARATUS FOR THE PRODUCTION OF METAL POWDER

(75) Inventors: Yoshihiro Hirata, Kyoto (JP); Yoshio Ueda, Kyoto (JP); Hiroaki Takase, Kyoto (JP); Kazuaki Suzuki, Kyoto (JP)

(73) Assignee: Phild Co., Ltd., Kyoto (JP)

( * ) Notice: Subject to any disclaimer, the term of this patent is extended or adjusted under 35 U.S.C. 154(b) by 443 days.

This patent is subject to a terminal disclaimer.

(21) Appl. No.: 10/493,903

(22) PCT Filed: Oct. 24, 2002

(86) PCT No.: PCT/JP02/11026

§ 371 (c)(1),
(2), (4) Date: Nov. 8, 2004

(87) PCT Pub. No.: WO03/037553

PCT Pub. Date: May 8, 2003

(65) Prior Publication Data

US 2005/0092132 A1 May 5, 2005

(30) Foreign Application Priority Data

Oct. 29, 2001 (JP) ..... 2001-330583

(51) Int. Cl.
*B22F 9/14* (2006.01)

(52) U.S. Cl. ..... 75/346; 75/370

(58) Field of Classification Search ..... 75/346
See application file for complete search history.

(56) References Cited

U.S. PATENT DOCUMENTS

| | | | |
|---|---|---|---|
| 3,171,813 A | 3/1965 | Inoue | |
| 4,731,515 A | 3/1988 | Savage et al. | |
| 5,879,518 A | 3/1999 | Kuehnle | |
| 7,108,735 B2 * | 9/2006 | Hirata et al. | 75/355 |

FOREIGN PATENT DOCUMENTS

| | | |
|---|---|---|
| JP | 63-267431 | 11/1988 |
| JP | 02-166202 | 6/1990 |
| JP | 07-024305 | 1/1995 |

OTHER PUBLICATIONS

Satsuta T., et al., "Preparation of metal powders utilizing electric discharge in water," Journal of the Japan Institute of Metals, vol. 57, No. 6, 1993 pp. 692-698.

* cited by examiner

*Primary Examiner*—George Wyszomierski
(74) *Attorney, Agent, or Firm*—Knobbe, Martens Olson & Bear LLP

(57) ABSTRACT

Provide a method and apparatus for producing, in an economical manner, metal powder offering high purity and comprising uniform particle shape and size. Produce metal powder of titanium metal, etc., using an apparatus that comprises a power supply for high-voltage/current discharge, a feeder of metal electrode made of titanium metal, etc., a high-voltage discharge generator equipped with a metal electrode made of titanium, etc., and its counter electrode, a water tank, a water inlet, an outlet for produced metal dispersion solution containing titanium metal, etc., a discharge pump, and an adjunct device for separating/recovering metal powder of titanium metal, etc., from the metal dispersion solution containing titanium metal, etc.

6 Claims, 2 Drawing Sheets

Apparatus for Producing Metal Powder Proposed by the Present Invention

METHOD AND APPARATUS FOR THE PRODUCTION OF METAL POWDER

This application is the U.S. National Phase under 35 U.S.C. §371 of International Application PCT/JP02/11026, filed on Oct. 24, 2002, which claims priority of Japanese Patent Application No. 2001-330583, filed on Oct. 29, 2001. The International Application was published under PCT Article 21(2) in a language other than English.

FIELD OF THE INVENTION

This invention relates to a method and apparatus for producing, in an economical manner, metal powder offering a high purity of elemental metal and comprising powder particles of uniform shape and size.

The invention also relates to a production of aforementioned metal powder from titanium, zirconium, germanium, tin, gold, platinum and silver, but applies chiefly to titanium powder production.

BACKGROUND OF THE INVENTION

Elemental metal materials, especially those offering a high purity of elemental metal, are processed into various shapes and sizes according to the required applications, such as powder-molded products, sheet metals, bars, thin wires and foil materials.

In recent years, metal powder offering high purity is drawing the attention as an effective molding material for use in various molding processes such as powder metallurgy and thermal spraying. Powder metallurgy is an important technology used in wide-ranging fields including the production of mechanical parts. Accordingly, demand for metal powder as a powder metallurgy material is also growing.

The traditional methods for producing metal powder include the classic method of mechanically and directly crushing metal particles into powder and the method to blow molten metal using gas and shape the blown droplets into powder form. However, these methods posed problems such as irregularities in particle shape and size, poor economy, and so on.

Electrolysis is one of the relatively new methods known for producing metal powder. However, electrolysis has been reported to produce metal of a brittle spongy or powder structure if metal deposition is implemented under a condition outside the optimal range where metal of a smooth, fine and uniform crystalline structure can be deposited. Even when deposition is achieved under an optimal condition, the metal powder obtained by the electrolysis method as presently known does not satisfy the required levels of purity or uniformity of metal particle shape and size. Other problems associated with this methods, such as poor economy, also remain unresolved.

Among other metals, titanium is a relatively new metal compared with iron or copper that has been known since the ancient times or aluminum. Being lightweight and offering excellent strength and corrosion resistance under high temperatures, titanium metal is used in a wide range of industrial applications.

The examples include jet engine material, structural members and other parts used in aircraft and spaceship, materials for heat-exchangers used in thermal or nuclear power generation, catalyst materials for use in polymer chemistry, and articles of daily use such as eyeglass frame and golf club head. Titanium is also used in various other fields including health products, medical equipment and dental materials, and the applications of titanium are expected to grow further. Titanium is already competing with stainless steel and duralumin, and is likely to become a material that will be in greater demand than these rival metals.

Titanium metal has poor processability and cutting property, and therefore using dispersed titanium material in a production of mechanical parts having a complex shape will require additional machining steps such as cutting after hot forging, rolling or other plastic working process. This inevitably increases process steps and adds to production costs.

For the above reason, powder metallurgy is often used in applications in which titanium metal is used, as mentioned earlier, and accordingly there is demand for titanium powder that offers high purity and uniform particle shape and size. When titanium powder is produced using the conventional powder production methods applicable to general metals, the produced titanium powder will pose problems, just like other metals produced in the same manners, in terms of irregularities in particle shape and size, poor economy, and so on. Therefore, development of a method for producing titanium powder that can yield higher purity and more uniform particle shape and size is eagerly awaited.

For example, improved production methods of titanium metal powder using the hydrogenation and dehydrogenation method and rotary electrode method have already found commercial use. The hydrogenation and dehydrogenation method is a technique to heat titanium sponge, dispersed titanium material or titanium scraps generated from cutting/machining processes in a hydrogen atmosphere to cause the titanium material to absorb hydrogen gas, and then crush the embrittled titanium material, after which the crushed titanium is again heated in a vacuum atmosphere to release hydrogen gas and consequently obtain titanium powder. The rotary electrode method uses a round bar formed from dispersed titanium material or processed dispersed titanium material, which is a forged, rolled or otherwise processed version of dispersed titanium, material. This round bar material is rotated at high speeds in an atmosphere of inactive gas such as argon or helium while its tip is dispersed using a heat source such as an arc or plasma arc, and the dripping molten metal is spattered by centrifugal force to obtain spherical powder particles. In the rotary electrode method, controlling the dispersion amount of the dispersing metal is very difficult.

Titanium powder obtained by the hydrogenation and dehydrogenation method has irregular sphericity. Therefore, although such powder can be used for die molding, the heating process must be repeated twice. While a mechanical crushing process using a ball mill may be devised, it will inevitably cause oxygen contamination of the titanium powder. On the other hand the rotary electrode method, wherein molten titanium material is shaped into powder form in an inactive gas atmosphere, produces spherical powder particles with good fluidity and there is no risk of oxygen contamination. However, this method has a drawback of poor solidification of molding material. In addition, both methods use batch processing and therefore the powder production costs are higher.

The atomization method was developed as a titanium powder production method aiming to resolve the aforementioned problems relating to quality and production costs. Under the atomization method, metal material is dispersed in a water-cooled copper crucible using a plasma arc or other heat source and the molten metal is caused to drip from one end of the crucible. Then, an inactive gas such as argon or helium is injected to this molten metal drips to atomize the molten metal and obtain powder. However, this method couldn't achieve significantly lower production costs compared with the conventional methods, since it also used dispersed titanium material and processed dispersed titanium material.

The invention described in Japanese Patent Application Laid-open No. 5-93213 presents a method for producing titanium powder that offers improved sphericity and fluidity to facilitate molding, in a manner requiring less production costs and avoiding oxygen contamination. However, this method, wherein titanium sponge is isostatically pressed in cold state and the solidified bar material is melted in an inactive gas atmosphere, and then an inactive gas such as argon or helium is injected to atomize the molten metal to obtain powder, still didn't provide powder of desired levels of purity as well as uniform sphericity and particle size and the production costs were not ideal, either.

DISCLOSURE OF THE INVENTION

Despite the growing needs and demands for metal powder—especially titanium metal powder—as mentioned above, on the back of advancement in new molding/processing methods such as powder metallurgy, the powder production methods developed to date have not been able to fully address the requirements for production of such metal powder. In particular, these methods posed problems in the purity of elemental metal, uniformity of sphericity and particle size, and production costs.

In view of the above situation, the present invention aims to produce and provide powder material offering excellent uniformity of sphericity and particle size and high purity of elemental metal, for use in molding processes such as powder metallurgy.

After studying numerous ways to improve the problems associated with the production of elemental metal powder such as titanium powder, including poor purity of elemental metal, irregularity of sphericity and particle size, and high production costs, the inventors have successfully solved the aforementioned problems by utilizing the technology filed earlier by the inventors relating to a production of high-function water containing titanium (Japanese Patent Application No. 2001-315446).

The aforementioned earlier invention concerning a production of high-function water containing titanium (Japanese Patent Application No. 2001-315446) relates to a method for producing high-function water in which titanium metal is micro-dispersed by means of causing plasma discharge in water between a titanium metal electrode and its counter electrode and then causing the generated metal ion vapor to contact, and disperse in, water. The present invention utilizes this technology to allow for production of elemental metal powder, especially titanium metal powder, offering excellent purity and uniformity of sphericity and particle size, at a significantly lower production cost.

The method and apparatus proposed by the present invention are fundamentally different in concept and structure from the conventional production methods for metal powder and titanium powder. Basically, the present invention aims to obtain metal powder as settlements in water by causing plasma discharge in water and thus converting elemental titanium metal into fine particles. This technique can also be applied to metals other than titanium, and the production method and apparatus proposed by the present invention indeed embody a notable improvement in metal powder production based on a completely different approach from those adopted by the conventional methods.

Specifically, the present invention, wherein the basic concept is to cause plasma discharge in water between an elemental metal electrode and its counter electrode and then cause the generated metal ion vapor to contact water and become powder form, comprises (1) through (7) specified below:

(1) A method for producing metal powder, wherein plasma discharge is caused in water between an electrode made of elemental metal and its counter electrode and the generated metal ion vapor is caused to contact water and become powder form.

(2) A method for producing metal powder as described in (1) above, wherein the elemental metal is titanium, zirconium, germanium, tin, gold, platinum or silver.

(3) An apparatus for producing metal powder, which comprises a power supply for high-voltage/current discharge, an elemental metal electrode feeder, a high-voltage discharge generator equipped with an elemental metal electrode and its counter electrode, a water tank, a water inlet to the water tank, an outlet for produced dispersion water of fine elemental metal particles, a discharge pump, and a filter system.

(4) The apparatus for producing metal powder as described in (3) above, wherein titanium, zirconium, germanium, tin, gold, platinum or silver is used as the elemental metal.

(5) The apparatus for producing metal powder as described in (3) or (4) above, wherein the elemental metal constituting the electrode has a bar, plate or wire shape.

(6) The apparatus for producing metal powder as described in any one of (3) through (5) above, wherein one electrode is made of elemental metal and its counter electrode is made of carbon and a pair of the electrodes are vibrated or slid to prevent fusion between the electrodes, and wherein instant plasma discharge is generated to control the amount of dispersion.

(7) The apparatus for producing metal powder as described in any one of (3) through (6) above, wherein the amount of current flowing through the circuit can be easily adjusted by changing the diameter and/or length of the carbon electrode.

The method and apparatus proposed by the present invention allow for production of elemental metal powder in a very efficient manner. In addition, the present invention does not generate any byproducts or impurities other than the target metal powder. The generation of metal oxide due to heating of the metal material is also very small, the obtained metal powder particles have excellent uniformity in their sphericity and size, and the production costs can be lowered significantly. Continuous production is also possible, in addition to batch production, so metal powder of uniform particle size can be produced in mass volumes at an economy that sufficiently meets the requirement for such commercial production.

In the production process proposed by the present invention, plasma discharge is caused in water between an elemental metal electrode and its counter electrode to obtain ion vapor of the elemental metal. As the vapor contacts water, it instantly disperses in water as fine particles to become fine powder. In addition, by comprising the counter electrode used in such underwater plasma discharge not from the same metal as the elemental metal electrode but from carbon, and also by vibrating or sliding the electrode pair, fusion between the electrodes can be prevented. Furthermore, achievement of instant plasma discharge makes it easy to control the amount of dispersion, and there is no need to select a different power supply for a given purpose because the amount of current flowing through the circuit can be easily adjusted by changing the diameter and length of the counter electrode made of carbon. Carbon particles that disperse simultaneously with metal particles are harmless and nearly the entire amount can be removed easily using a filter system, thereby enabling a production of metal dispersion water of high purity. Through these processes the fine particles of the elemental metal used as an electrode are obtained as proposed by the present invention.

According to the present invention, fine metal powder of zirconium, germanium, tin, gold, platinum or silver can be produced in addition to titanium powder, by using a desirable metal as the elemental metal material.

The basic structure of the present invention provides a method for producing metal powder of uniform particle size by causing plasma discharge in water between an electrode made of elemental metal and its counter electrode made of carbon, etc., and then causing the generated metal ion vapor to contact water and become powder form, as explained above. The production flow chart shown in FIG. 1 outlines this production process.

As shown in FIG. 1, distilled water or other demineralized water is filled in a water tank used for titanium metal powder production. Then, an electrode made of titanium metal bar, etc., is fed by a feeder of elemental metal electrode, and plasma discharge is caused in water between the elemental metal electrode and its counter electrode made of carbon bar. When the elemental metal ion vapor generated by underwater discharge contacts water, the vapor instantly disperses in water. At this time, very small fine titanium particles of micron-scale are produced and dispersed as powder to form dispersion water of the elemental metal. This fine elemental metal powder in water does not melt or float and instead settles after a brief period. This powder can be refined by filtering to obtain fine elemental metal powder. The obtained fine elemental metal powder has high purity as well as uniform sphericity and particle size.

Figure 1:
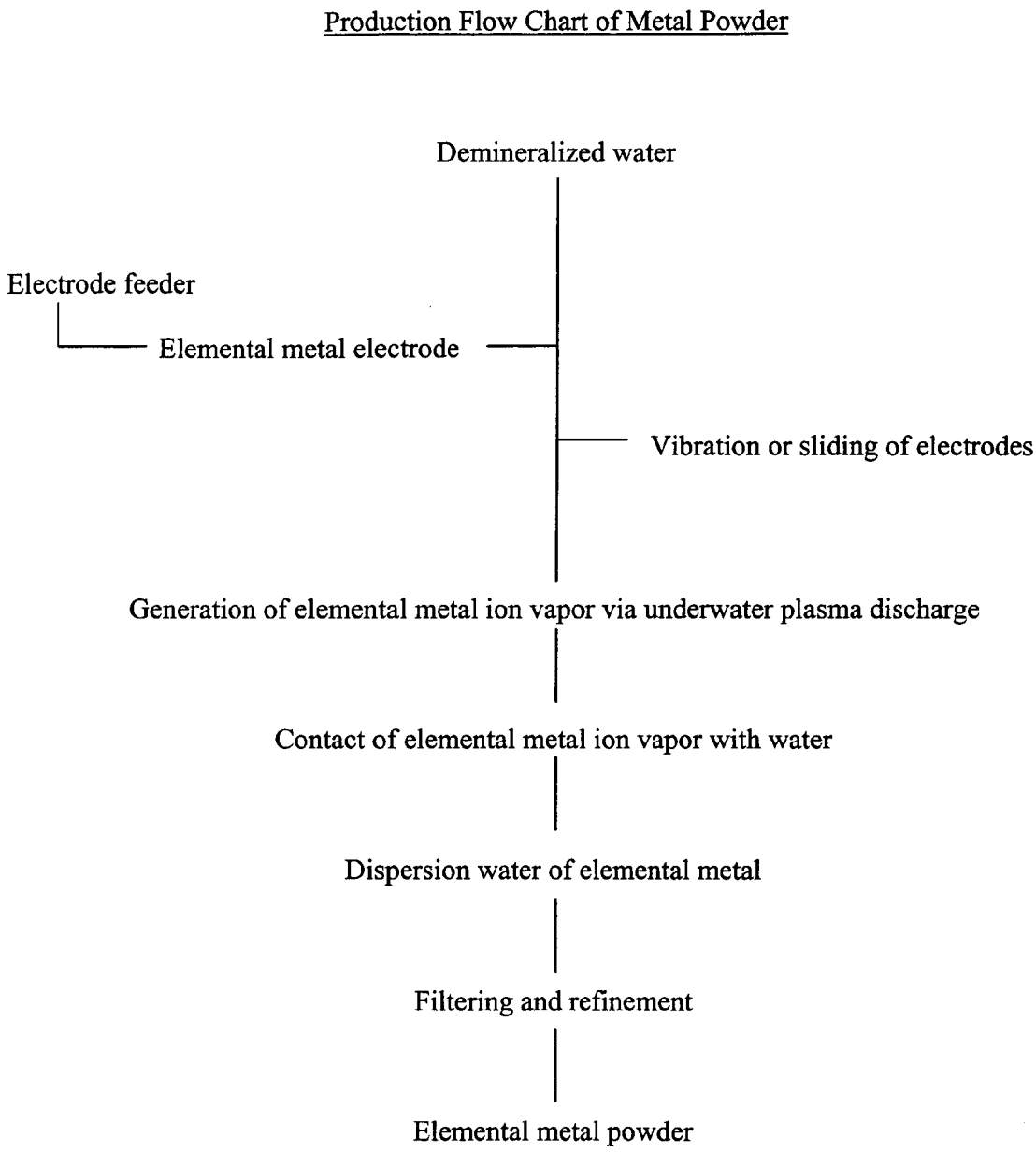
"FIG. 1"

A production flow chart of metal powder as proposed by the present invention

"FIG. 2"

An apparatus for producing metal powder as proposed by the present invention

EXPLANATION OF THE SYMBOLS

1. Plasma discharge generator
2. Power supply for high-voltage/current discharge
3. Electrode-vibrating/sliding device
4. Elemental metal electrode feeder
6. Elemental metal electrode
7. Counter electrode
8. Water inlet
9. Outlet for elemental metal dispersion solution
10. Discharge pump
11. Filter system
12. Filtrate
13. Metal powder
14. Water tank

BEST MODE FOR CARRYING OUT THE INVENTION

An example of titanium metal powder production is explained below. Note, however, that the present invention is not limited to a production of titanium powder.

Although the present invention allows for production of pure titanium powder in a very efficient manner, controlling the feed rate of the electrode made of titanium metal is very important in achieving such efficient production of pure titanium powder. For example, the amount of current flowing through the circuit can be adjusted by changing the diameter and length of the carbon counter electrode as one such means.

According to the production apparatus proposed by the present invention, plasma discharge is caused in water inside a water tank. Therefore, a water tank with sufficient pressure resistance that can withstand the high pressure required in underwater plasma discharge is needed.

In addition, by comprising the counter electrode used in discharge not from the same metal as the elemental metal electrode but from carbon, and also by vibrating or sliding the electrode pair, fusion between the electrodes can be prevented. Furthermore, achievement of instant plasma discharge makes it easy to control the amount of dispersion, and there is no need to select a different power supply for a given purpose because the amount of current flowing through the circuit can be easily adjusted by changing the diameter and length of the counter electrode made of carbon. Carbon particles that disperse simultaneously with element metal particles are harmless and nearly the entire amount can be removed easily via filtering, thereby enabling a production of elemental metal dispersion water of high purity.

The electrode made of titanium metal material may have a bar, plate or wire shape. In the case of a small production tank with a capacity much smaller than one ton, it will be more appropriate to introduce titanium metal as a wire, instead of a bar.

Other than titanium, the elemental metal materials from which metal powder can be produced using the production apparatus proposed by the present invention include zirconium, germanium, tin, gold, platinum and silver. However, possible applications of the present invention are not limited to these elemental metals.

An example of the present invention is explained according to the drawings. Note, however, that the present invention is not limited to this example.

FIG. 1 shows a production flow chart of metal powder according to the present invention as explained above.

Figure 2:
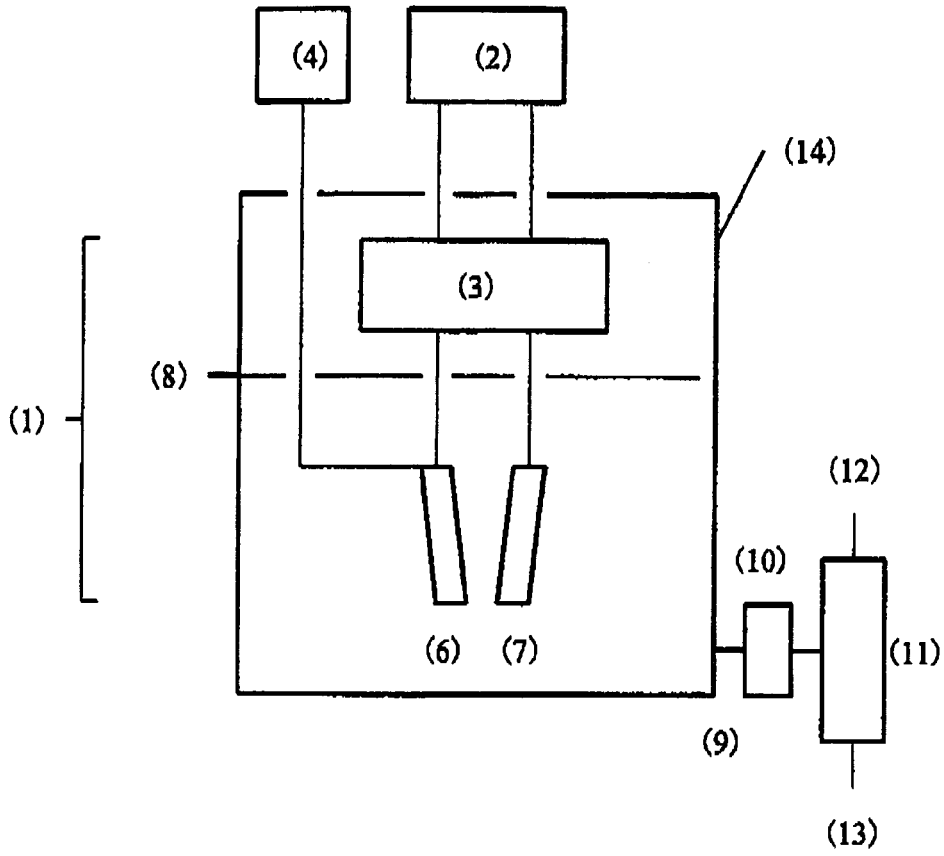

FIG. 2 illustrates an apparatus for producing metal powder proposed by the present invention, which comprises a water tank (14), a plasma discharge generator (1) equipped with an elemental metal electrode and its counter electrode, and a filter system (11) for filtering elemental metal powder.

A pressure-resistant container used for metal powder production is equipped with a power supply for high-voltage/current discharge (2), a device for vibrating or sliding electrodes (3), a device for feeding elemental metal electrode (4), the plasma discharge generator (1) equipped with an elemental metal electrode (6) and its counter electrode (7), a water inlet (8) to the water tank (14), an outlet (9) for elemental metal dispersion solution generated by plasma discharge in water, a discharge pump (10), and the filter system (11) for separating metal powder from the elemental metal dispersion solution. Produced metal powder is denoted as (13).

Demineralized water is fed into the water tank installed in the plasma discharge generator.

Plasma discharge is caused between the elemental metal electrode made of titanium and its counter electrode made of carbon, which are both submerged in water inside the tank. Underwater plasma discharge generates titanium ion vapor, and when this vapor contacts water a dispersion solution of titanium metal is produced.

As for plasma discharge, fusion between the electrodes can be prevented by vibrating or sliding the electrodes using the sliding/vibrating device (3), and achievement of instant plasma discharge makes it easy to control the amount of dispersion. In addition, the titanium metal electrode is fed continuously or intermittently using the electrode feeder (4) so as to ensure the electrode is consumed sequentially by the necessary amount. Underwater plasma discharge instantly melts the titanium material and causes the molten titanium to disperse in water.

In this process, very small fine titanium particles of micron-scale (4) are generated and dispersed as powder. The generated titanium metal powder doesn't melt or float and instead settles as powder after a brief period to separate from water. The obtained water is retrieved from the outlet for titanium metal powder (9) and filtered through the filter system (11) into filtrate (12) and titanium powder (13). When 25 kg of titanium metal bar was consumed in the water tank filled with one ton of water, the resulting water contained a small amount of dissolved titanium. However, the rest of the titanium electrode did settle at the bottom of the container as titanium powder. The average particle size of this titanium powder was 10 to 30 μm.

In addition, the obtained titanium powder contained no byproducts or impurities and the titanium powder particles had very uniform sphericity and particle size.

The present method and apparatus indeed produced titanium powder of uniform particle size in a very economical manner.

INDUSTRIAL FIELD OF APPLICATION

The present invention allows for production in a very efficient and stable manner of metal powder, especially titanium powder, offering high purity. The production method proposed by the present invention eliminates generation of byproducts and impurities other than the target metal content, and the obtained powder has excellent uniformity in terms of sphericity and particle size. Additionally, the compact, efficient apparatus achieves significant reduction in production costs. Furthermore, the present invention can be applied to batch production, continuous production and mass production.

What is claimed is:

1. A method for producing metal powder comprising:

causing plasma discharge in a high pressure water between an electrode made of elemental metal and its counter electrode to generate metal ion vapor; and contacting the generated metal ion vapor with water to convert the metal ion vapor to metal powder.

2. The method for producing metal powder as described in claim 1, wherein the elemental metal is titanium, zirconium, germanium, tin, gold, platinum or silver.

3. A method for producing metal powder comprising:

causing plasma discharge in water between an electrode made of elemental metal and its counter electrode to generate metal ion vapor; and contacting the generated metal ion vapor with water to convert the metal ion vapor to metal powder.

4. The method for producing metal powder as described in claim 3, wherein the elemental metal is titanium, zirconium, germanium, tin, gold, platinum or silver.

5. The method for producing metal powder as described in claim 3, comprising vibrating or sliding said electrode and its counter electrode to prevent fusion between the electrodes, and generating instant plasma discharge to control the amount of dispersion of said metal ion vapor.

6. The method for producing metal powder as described in claim 3, comprising adjusting the amount of current flowing through a circuit by changing the diameter and/or length of said counter electrode.

* * * * *